US007963408B2

(12) United States Patent
Glover

(10) Patent No.: US 7,963,408 B2
(45) Date of Patent: Jun. 21, 2011

(54) STORAGE TRAY SYSTEM

(75) Inventor: David Glover, Wavendon (GB)

(73) Assignee: Certwood Limited, Luton/Bedfordshire (GB)

( * ) Notice: Subject to any disclaimer, the term of this patent is extended or adjusted under 35 U.S.C. 154(b) by 274 days.

(21) Appl. No.: 11/874,793

(22) Filed: Oct. 18, 2007

(65) Prior Publication Data

US 2008/0093320 A1 Apr. 24, 2008

(30) Foreign Application Priority Data

Oct. 20, 2006 (GB) ..... 0620866.4

(51) Int. Cl.
*A47F 3/14* (2006.01)

(52) U.S. Cl. ..... 211/126.15; 312/323; 312/334.7; 211/162

(58) Field of Classification Search ..... 211/126.15, 211/126.1, 126.2, 133.6, 128.1, 126.14, 188, 211/162, 46; 312/28, 29, 131, 132, 334.4, 312/334.5, 334.7, 322, 323
See application file for complete search history.

(56) References Cited

U.S. PATENT DOCUMENTS

| | | | | | |
|---|---|---|---|---|---|
| 776,736 | A | * | 12/1904 | Greenen | 312/323 |
| 2,242,903 | A | * | 5/1941 | Crimmel | 108/26 |
| 3,519,319 | A | * | 7/1970 | Taylor | 312/246 |
| 3,716,282 | A | * | 2/1973 | Propst et al. | 312/322 |
| 3,722,975 | A | | 3/1973 | Taylor | |
| 3,980,363 | A | * | 9/1976 | Dean et al. | 312/294 |
| 4,190,306 | A | * | 2/1980 | Litchfield et al. | 312/348.2 |
| 4,212,503 | A | * | 7/1980 | Litchfield et al. | 384/21 |
| 4,305,625 | A | * | 12/1981 | Gutner et al. | 384/19 |
| 4,314,734 | A | * | 2/1982 | Grunert | 312/322 |
| 4,441,771 | A | * | 4/1984 | Roesler | 312/322 |
| 4,453,790 | A | * | 6/1984 | Cohen et al. | 312/334.7 |
| 4,765,699 | A | * | 8/1988 | Bessinger et al. | 312/334.46 |
| 5,065,920 | A | * | 11/1991 | Amner | 224/275 |
| 5,244,272 | A | * | 9/1993 | Thompson | 312/334.23 |
| 5,399,006 | A | * | 3/1995 | Murazumi | 312/109 |
| 6,042,168 | A | * | 3/2000 | Bieri | 296/37.12 |

FOREIGN PATENT DOCUMENTS

| | | | |
|---|---|---|---|
| EP | 0063250 | A2 | 10/1982 |
| GB | 441598 | A | 1/1936 |
| GB | 564438 | A | 9/1944 |
| GB | 620113 | A | 3/1949 |
| GB | 678763 | A | 9/1952 |
| GB | 849546 | A | 9/1960 |
| JP | 6304029 | A | 11/1994 |

* cited by examiner

*Primary Examiner* — Darnell M Jayne
*Assistant Examiner* — Patrick Hawn
(74) *Attorney, Agent, or Firm* — Knobbe, Martens, Olson & Bear, LLP

(57) ABSTRACT

A storage tray system which includes a rack and a plurality of storage trays. The rack includes a plurality of tray runners for supporting the trays in the rack, and which allow sliding movement of the storage trays between open and closed positions. The storage trays can be inclined downwards when in the open position to allow access to their contents.

7 Claims, 7 Drawing Sheets

STORAGE TRAY SYSTEM

RELATED APPLICATION

This application claims priority under 35 U.S.C. §119(a)-(d) to Great Britain Patent Application No. 0620866.4, filed Oct. 20, 2006, the entire content of which is incorporated herein by reference.

BACKGROUND OF THE INVENTION

1. Field of the Invention

The present invention relates to a storage tray system.

2. Description of the Related Art

Storage tray systems are widely used in schools, hospitals and other institutions, for example for storing pupils' work, medical supplies and other items. Typically, a storage tray system comprises a set of moulded plastic trays that may be stored in a metal rack or a wooden cabinet and removed when the contents of the tray are required. The trays can also be opened like drawers to allow items to be placed in or removed from the trays. However, a tray cannot be opened too far as this may cause it to fall out of the rack. The system therefore provides only restricted access to the contents of the trays when they are used in "drawer mode", without being fully withdrawn from the rack.

Another disadvantage of the existing system is that the rack is very bulky and therefore uneconomical to transport and store prior to installation.

SUMMARY OF THE INVENTION

It is an object of the present invention to mitigate one or more of the above disadvantages.

According to the present invention there is provided a storage tray system including a rack and a plurality of storage trays that are constructed and arranged to be placed in or removed from the rack, the rack including a plurality of tray runners for supporting the trays in the rack, the tray runners being constructed and arranged to allow sliding movement of the storage trays between open and closed positions, at least one of the tray runners including a stop element that is constructed and arranged to engage a respective storage tray when in the open position so as to limit movement of the tray.

The provision of a stop element limits movement of the tray as it is pulled open, thereby preventing it from accidentally falling out of the rack. The tray may still be removed however when required, by disengaging the stop element (for example by lifting the tray).

Preferably, the tray runner is constructed and arranged to permit limited tilting of the storage tray when in an open position, to allow easier access to the contents of the tray. The tray runner may include upper and lower support elements, wherein the upper support element includes a formation such as an opening or a recess that accommodates the rear edge of the tray when tilted. The lower support element may include a portion adjacent its front end that is inclined downwards to permit tilting of the tray.

The stop element preferably comprises an upstanding tooth that engages a complementary stop element located beneath the rim of the storage tray.

The tray runner is preferably constructed and arranged to be mounted in a second configuration, in which the stop element is ineffective. In this configuration, the tray can be removed from the rack without having to disengage the stop element.

Advantageously, the tray runner includes a stop element to restrict movement of the storage trays when in the closed position.

Preferably, the rack includes one or more frame elements to which the tray runners are attached. The tray runners may be constructed and arranged to be attached to the frame elements during installation. This allows the rack to be stored and transported in a partially assembled condition, thereby reducing the size of the unit and providing economies during storage and transportation.

The tray runners are preferably moulded plastics components, made for example of glass-filled nylon.

According to another aspect of the invention there is provided a storage tray system comprising a rack and a plurality of storage trays that are constructed and arranged to be placed in or removed from the rack, wherein the rack includes one or more frame elements and a plurality of tray runners that may be attached to the frame elements.

BRIEF DESCRIPTION OF THE DRAWINGS

An embodiment of the invention will now be described by way of example with reference to the accompanying drawings, in which.

DETAILED DESCRIPTION OF THE INVENTION

Figure 1:
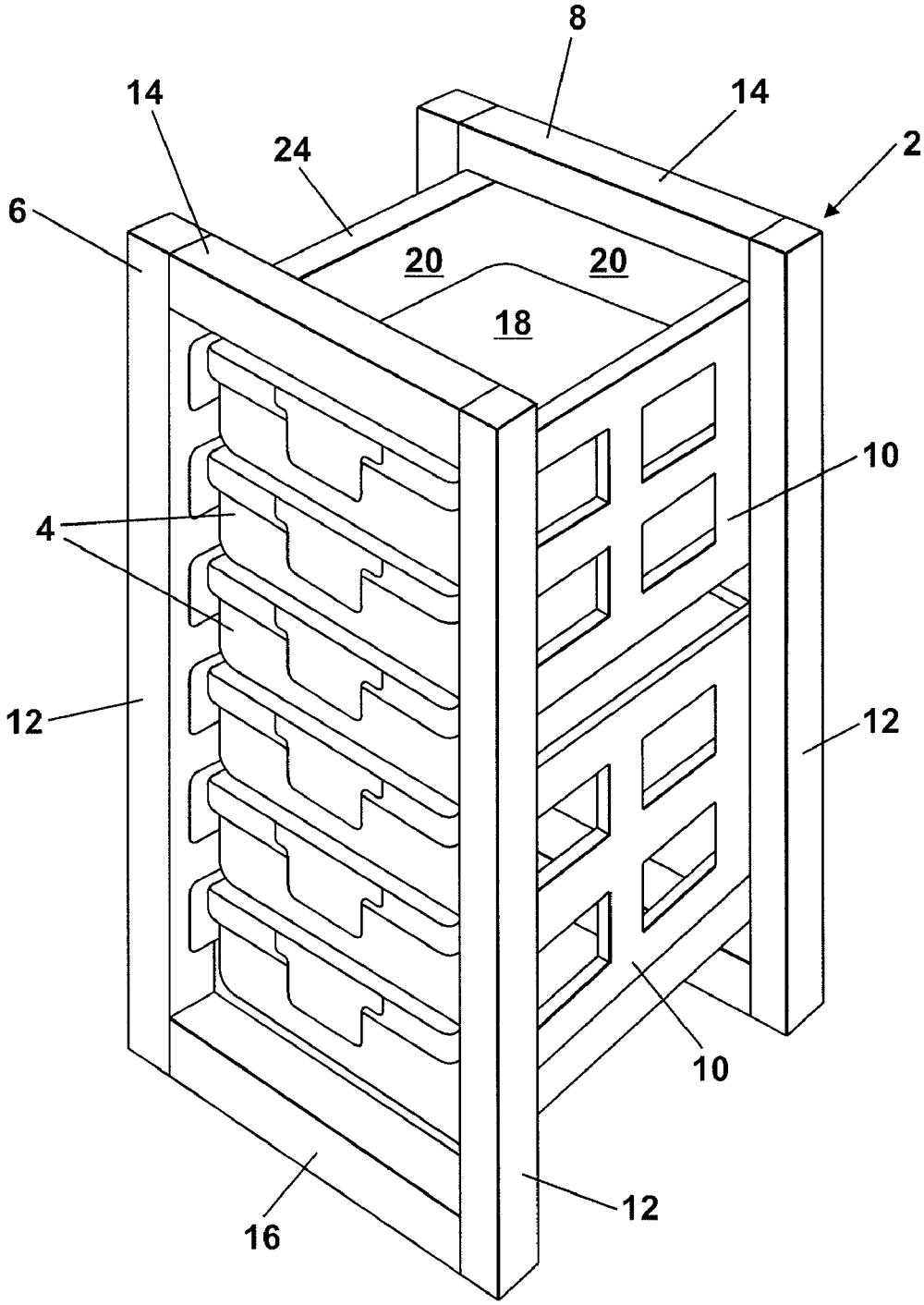
FIG. 1 is a perspective view of a storage tray system including a rack and a plurality of removable trays.
Figure 2:
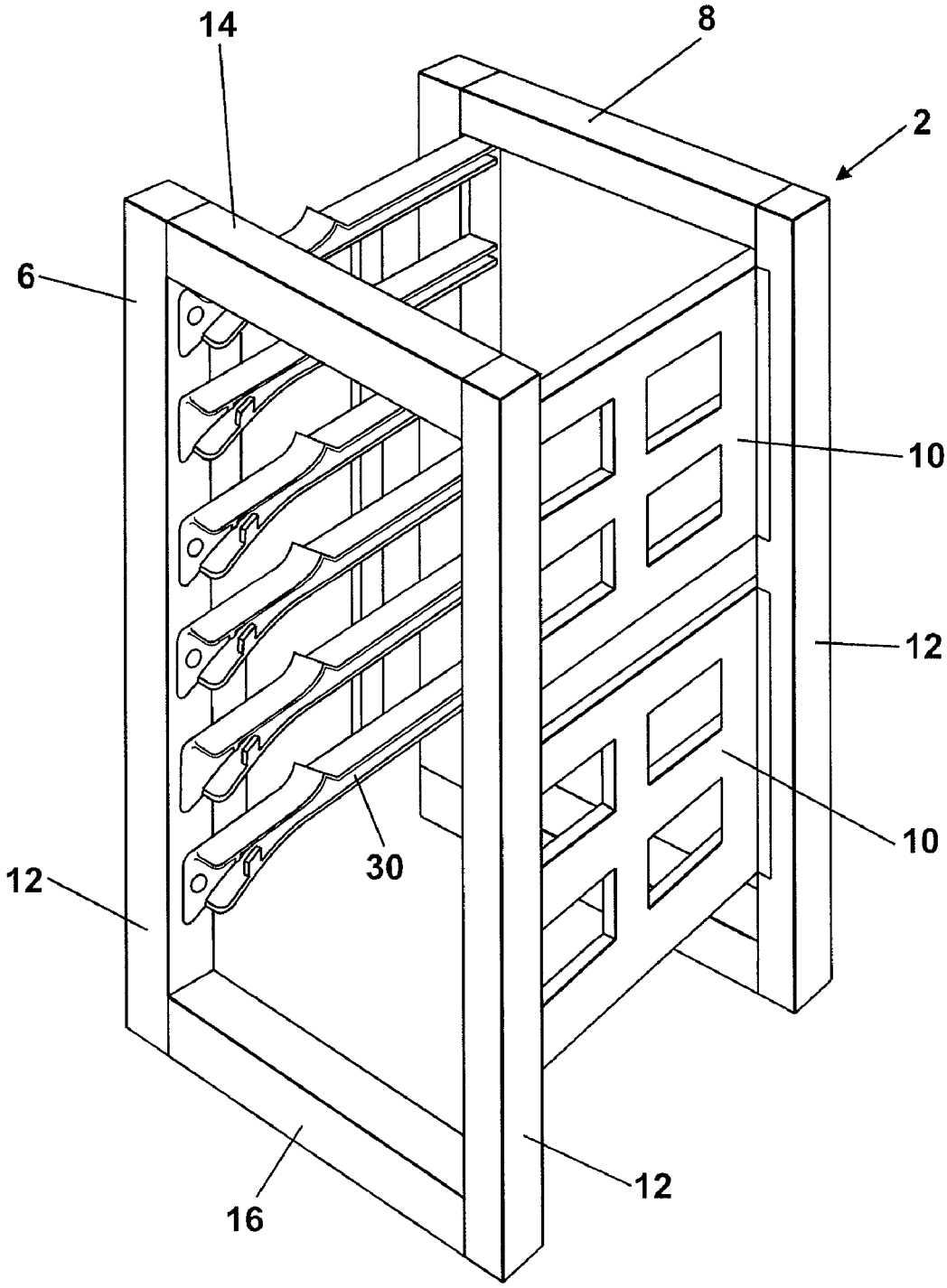
FIG. 2 is a perspective view of the rack with the trays removed.
Figure 3:
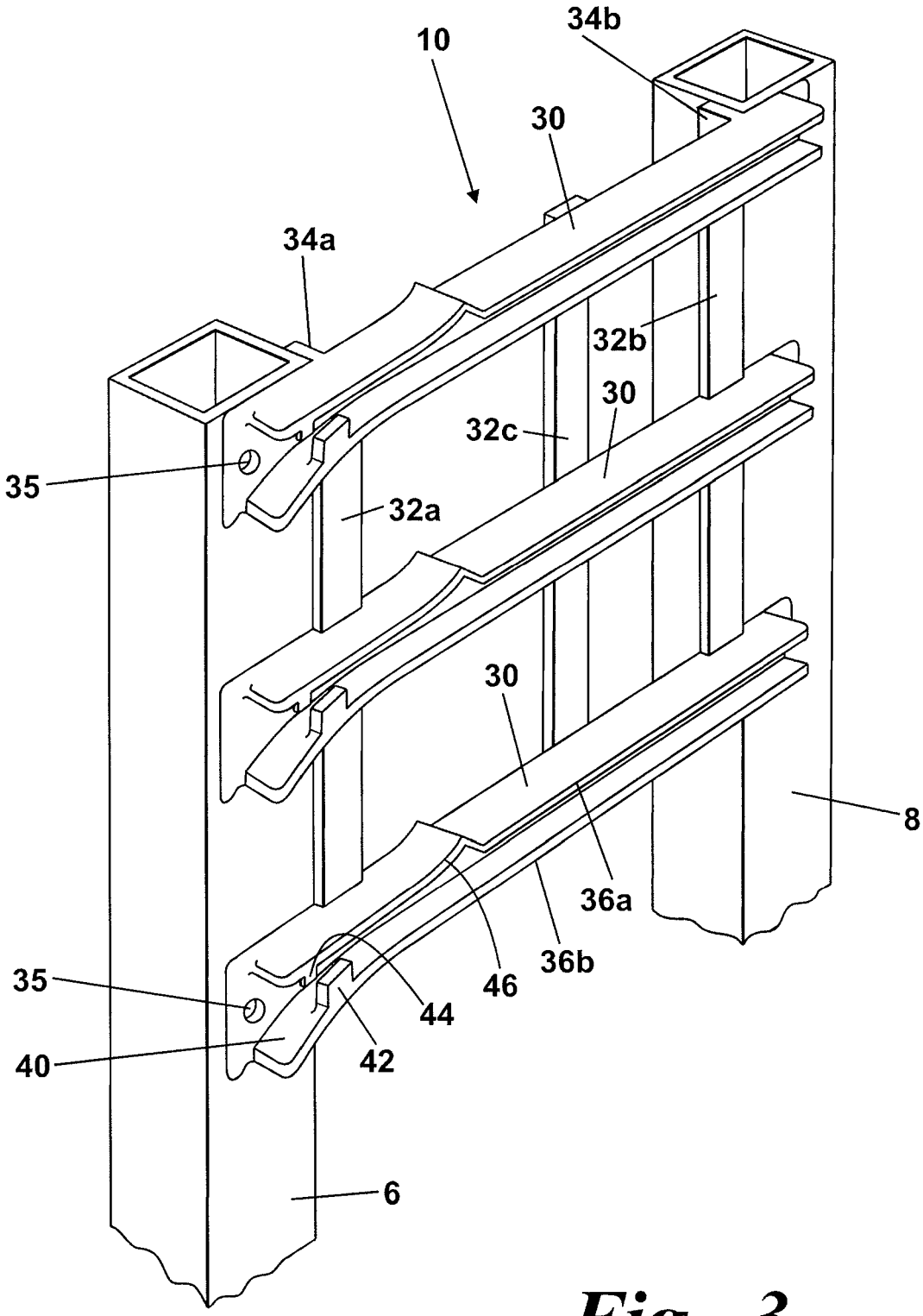
FIG. 3 is a perspective view showing part of the rack, including two frame elements and a set of tray runners.
Figure 4:
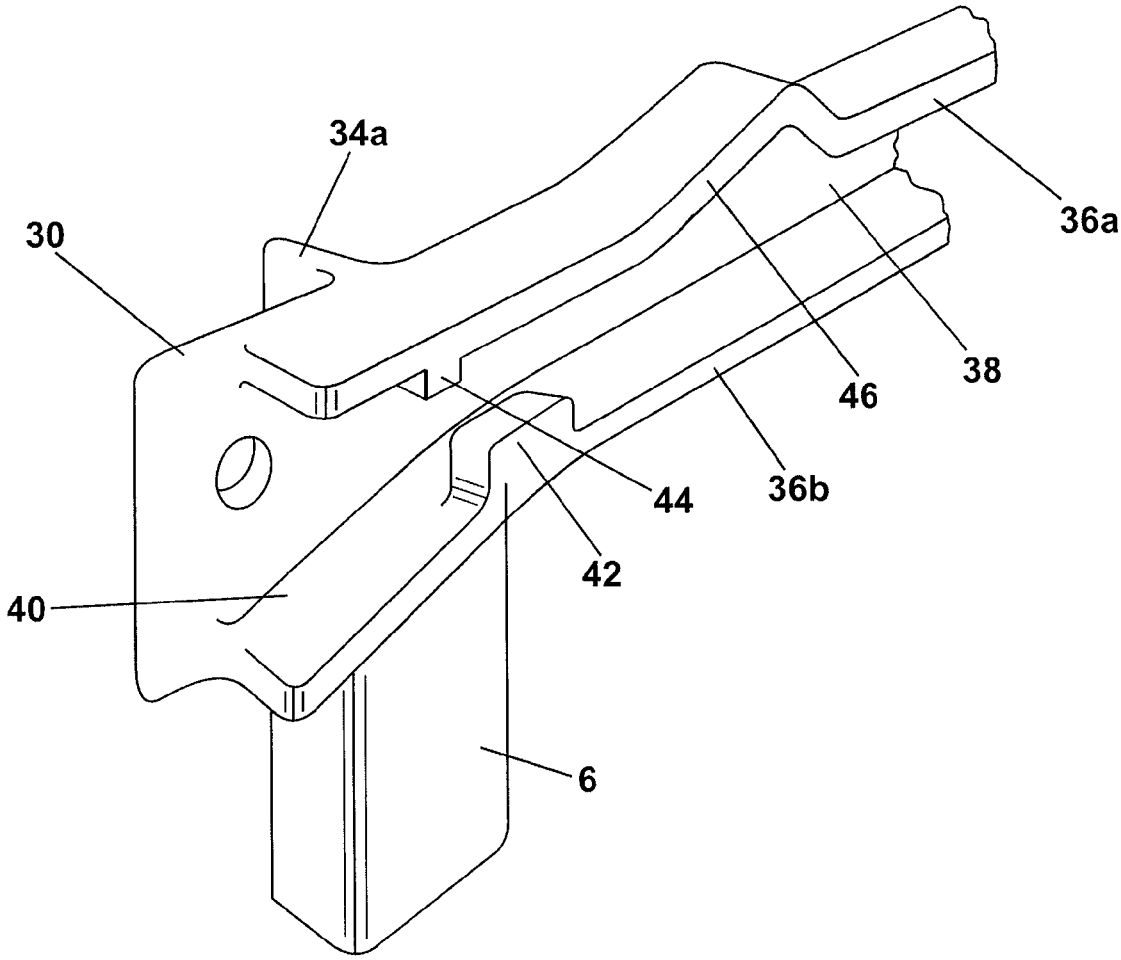
FIG. 4 is a perspective view showing part of a tray runner at an enlarged scale.
Figure 5:
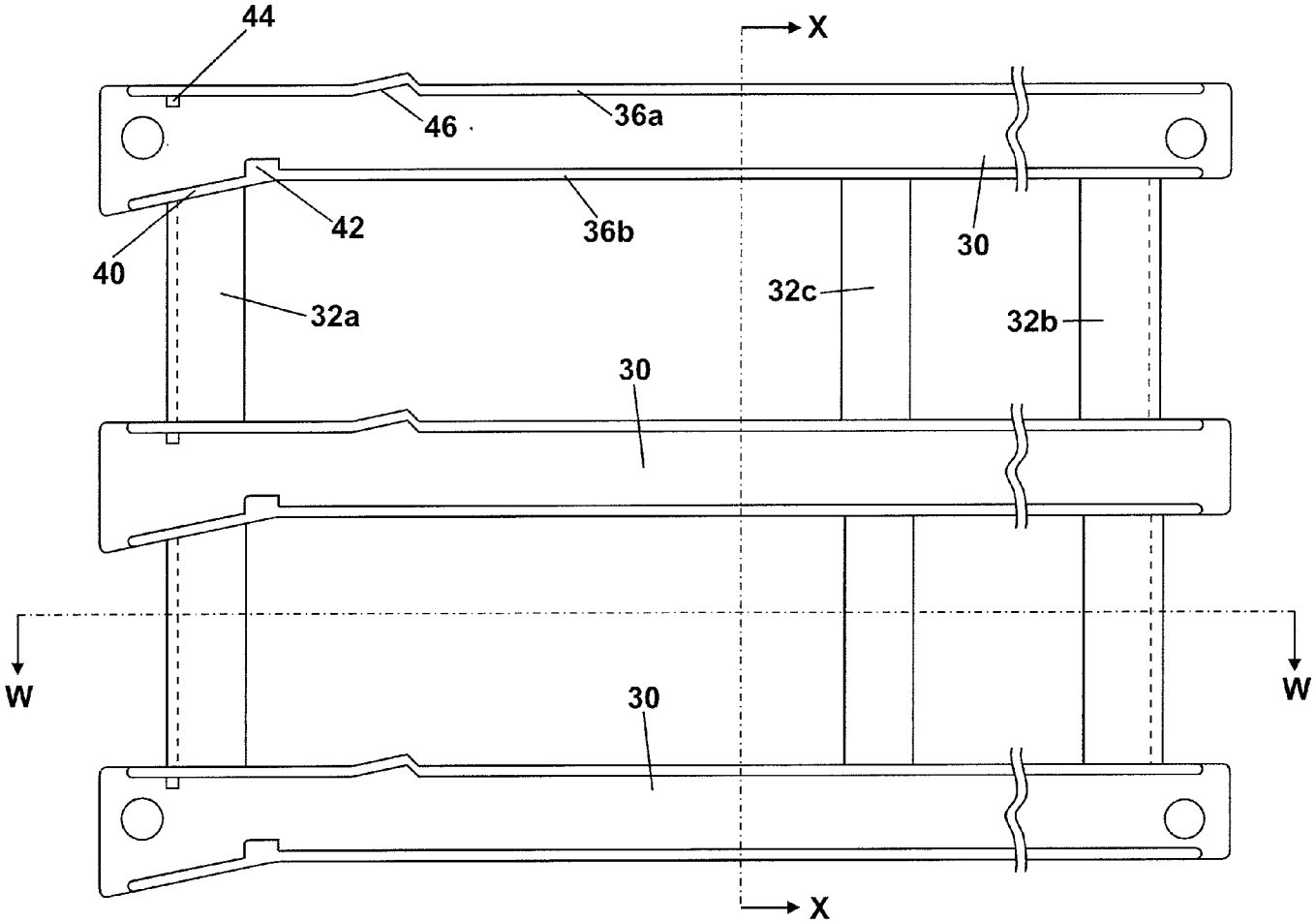
FIG. 5 is a side elevation showing a tray runner assembly.
Figures 6, 7, 8:
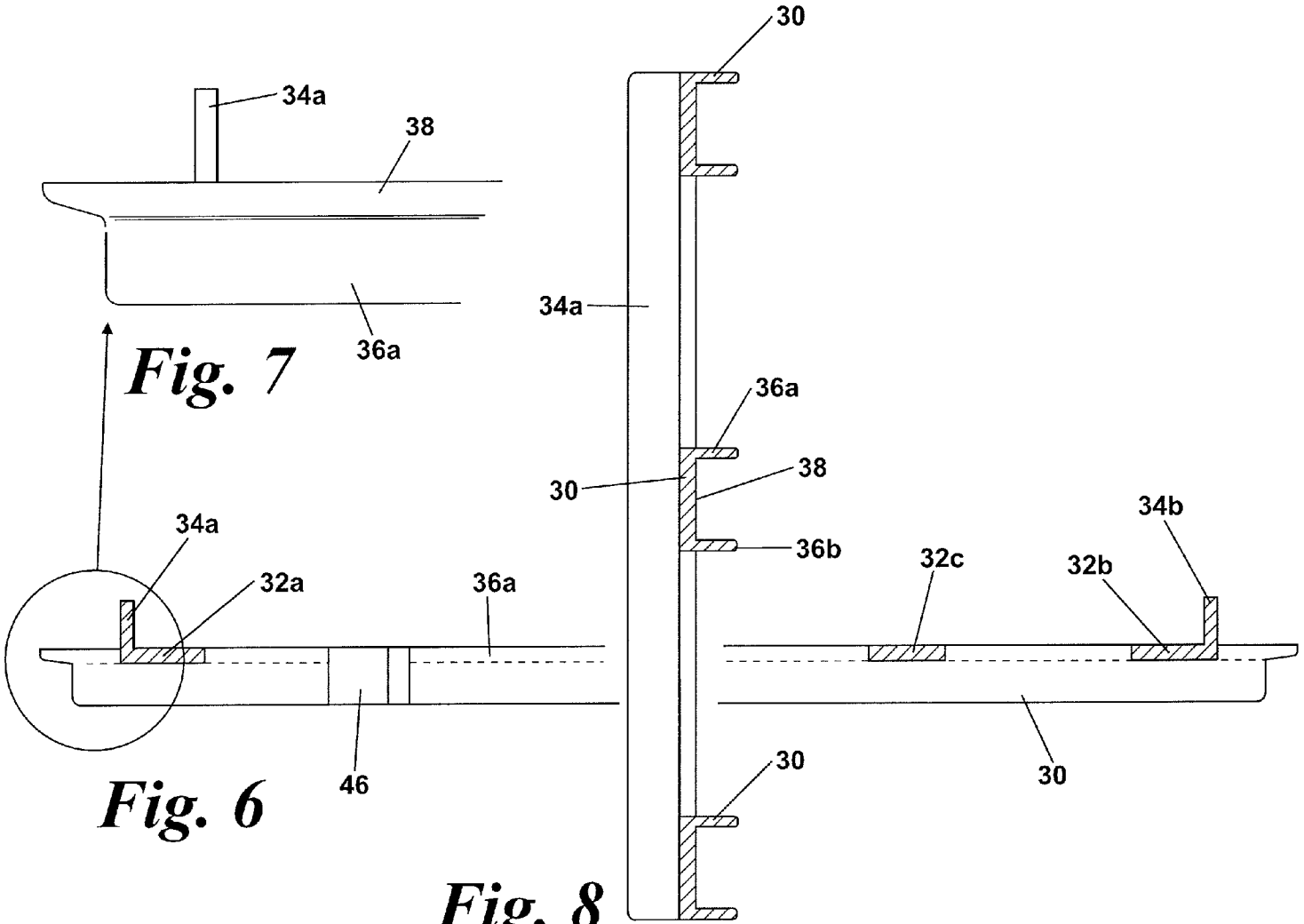
FIG. 6 is a section on line W-W, showing part of the tray runner assembly from above.
FIG. 7 is a plan view from above, showing part of the tray runner assembly at a larger scale.
FIG. 8 is a section on line X-X, showing part of the runner assembly.

The storage tray system includes a rack 2 and a plurality of storage trays 4 that are removably mounted in the rack 2.

The rack 2 includes front and rear frame elements 6,8 and a plurality of runner assemblies 10 that form the sides of the frame and interconnect the frame elements 6,8. Each frame element 6,8 comprises a rectangular welded steel frame having two uprights 12, an upper beam 14 and a lower beam 16.

Figure 9:
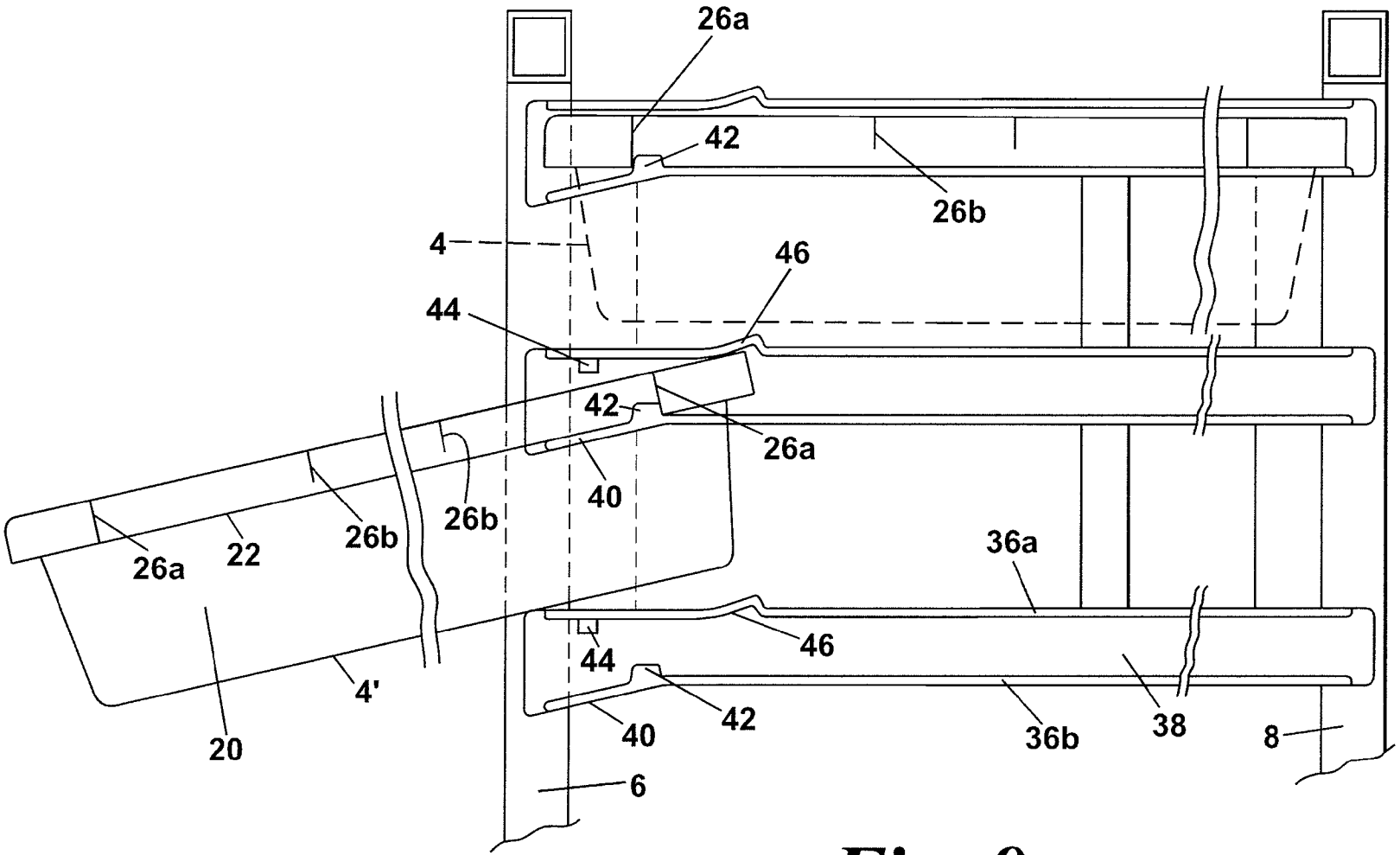
FIG. 9 is a sectional side view showing part of the rack and two trays in open and closed positions.

The tray 4 includes a substantially rectangular base 18 and four upstanding walls 20. At the upper edge of each wall 20 a down-turned rim 22 is provided, which is connected to the wall by an outwards extending flange 24. A plurality of strengthening webs 26*a,b* connect the rim 22 to the wall 20 at various points along its length. As shown in FIG. 9, the two webs 26*a* that are located on the side of the tray towards its ends extend downwards to the full depth of the rim 22, whereas the two intermediate webs 26*b* are slightly shorter and end just above the lower edge of the rim 22. The tray 4 is moulded from a plastics material, for example high impact polystyrene.

Each tray runner assembly 10 includes a set of three vertically spaced tray runners 30, which are interconnected by front, rear and middle vertical support bars 32*a,b,c*. The front and rear support bars 32*a,b* include perpendicular strengthening ribs 34*a,b* and are arranged to engage the front and rear support elements 6,8 respectively. The tray runner assembly 10 is attached to front and rear support element 6,8 by screws 35 that extend through the ends of the runners 30.

Each tray runner 30 includes upper and lower horizontal support elements 36*a,b* and a vertical wall element 38. At the front end of each runner 30, the lower support element 36*b* includes a downwardly inclined portion 40. A stop element 42 in the form of an upstanding tooth is formed on the lower support element 36*b* at the start of the inclined portion 40. Towards the front end of the runner 30, the upper support element 36*a* includes a downwards extending stop element 44. Also towards the front end of the runner 30, but set a little further back, the upper support element 36*a* includes an upwards extending recessed portion 46.

In use, the rim 22 of the tray 4 is supported on the lower support element 36*b* of a runner 30 on each side of the rack 10. The tray may be configured in a closed position as shown in FIG. 1 and FIG. 9 (upper tray 4) or it may be pulled out to an open position as shown in FIG. 9 (lower tray 4'). The rim 22 of the tray slides along the runner 30 to allow easy movement of the tray.

When the tray 4 is in the closed position, the stop element 42 engages the web 26*a* at the front end of the tray to limit rearwards movement. When the tray is open, the stop 42 engages the web 26*a* at the rear of the tray to limit forwards movement and prevent the tray from falling out of the rack. The intermediate webs 26*b* are shorter than the front and rear webs 26*a* and therefore pass over the stop element 42 without engaging it.

As shown in FIG. 9, when the tray 4' is in the open position, it can tilt forwards owing to the inclined portion 40 at the front end of the runner 30, and the recess 46 in the upper support element 36*a*, which accommodates and supports the rear edge of the tray. The tray can also be removed from the rack by lifting it slightly so that the web 26*a* at the rear of the tray passes over the stop element 42.

Alternatively, the runner assembly 10 can be rotated 180° about a horizontal axis and attached to the frame elements 6,8 in an inverted condition. Rearwards movement of the tray will then be restricted by the second stop element 44, which engages the rim 22 at the rear of the tray. Forwards movement of the tray will be unrestricted, allowing the tray to be opened or completely removed from the rack 2 without any restriction.

Various modifications of the system are of course possible. For example, the height of the rack 2 may be modified to accommodate more or fewer trays 4, or it may be adapted to house two or more columns of trays. The rack 2 may be supplied as a modular unit, which can be interconnected vertically and/or horizontally with other racks to support different numbers of trays. Instead of a metal frame, the rack 2 may consist of a wooden cabinet to which the runner assemblies 10 are attached. Each runner assembly 10 may have more or fewer than three tray runners 30. The runner assemblies 10 may also be designed to be interconnected. The rack 2 may also include support feet or wheels/castors to allow for easy movement.

What is claimed is:

1. A storage tray system including a rack and a plurality of storage trays that are constructed and arranged to be placed in or removed from the rack, each storage tray including a base, upstanding walls, a down-turned rim at the upper edge of each wall and a first stop element located beneath the rim extending downwards the full depth of the rim, the rack including a plurality of tray runners for supporting the trays in the rack, the tray runners being constructed and arranged to support the rim of a storage tray and allow sliding movement of the storage tray between open and closed positions, at least one of the tray runners including a second stop element that is constructed and arranged to engage the first stop element of a respective storage tray when in the open position so as to limit movement of the tray, wherein at least one of the tray runners is constructed and arranged to permit limited downwards tilting of the storage tray when in an open position to allow easier access to the contents of the tray, said tray runner includes upper and lower support elements, the upper support element includes a formation comprising an opening or recess that extends upwards from the upper support element and that accommodates and supports the rear edge of the tray when tilted downwards in the open position, and the lower support element includes a portion adjacent its front end that is inclined downwards to permit downwards tilting of the tray in the open position, and which supports the rim of the tray when tilted downwards in the open position, said second stop element comprising an upstanding tooth formed on the lower support element at the start of the inclined portion.

2. A storage tray system according to claim 1, wherein the tray runner includes a stop element to restrict movement of the storage trays when in the closed position.

3. A storage tray system according to claim 1, wherein the rack includes one or more frame elements to which the tray runners are attached.

4. A storage tray system according to claim 1, wherein the tray runners are constructed and arranged to be attached to the frame elements during installation.

5. A storage tray system according to claim 1, wherein the tray runners are moulded plastics components.

6. A storage tray system comprising a rack and a plurality of storage trays that are constructed and arranged to be placed in or removed from the rack, each storage tray including a base, upstanding walls, a down-turned rim at the upper edge of each wall and a first stop element located beneath the rim extending downwards the full depth of the rim, wherein the rack includes one or more frame elements and a plurality of tray runners that may be attached to the frame elements for supporting the trays in the rack, the tray runners being constructed and arranged to support the rim of a storage tray and allow sliding movement of the storage trays between open and closed positions, at least one of the tray runners including a second stop element that is constructed and arranged to engage the first stop element of a respective storage tray when in the open position so as to limit movement of the tray, wherein at least one of the tray runners is constructed and arranged to permit limited downwards tilting of the storage tray when in an open position to allow easier access to the contents of the tray, said tray runner includes upper and lower support elements, the upper support element includes a formation comprising an opening or recess that extends upwards from the upper support element and that accommodates and supports the rear edge of the tray when tilted downwards in the open position, and the lower support element includes a portion adjacent its front end that is inclined downwards to permit downwards tilting of the tray in the open position, and which supports the rim of the tray when tilted downwards in the open position said second stop element comprising an upstanding tooth formed on the lower support element at the start of the inclined portion.

7. A method for accessing contents of a storage tray, comprising providing the storage tray system of claim 6;

supporting each of the plurality of storage trays in each of the plurality of tray runners in a closed position on the rack;

moving one of the storage trays from the rack from the closed position to the open position by sliding said storage tray along its respective tray runner until the storage tray is engaged by the stop element in the tray runner;

downwardly tilting the storage tray in the open position;

supporting the rear edge of the tilted tray on the upper support element on said tray runner, said upper support element comprising a formation that comprises an opening or upwards extending recess in said tray runner; and supporting the tilted tray on the portion of the lower support element on said tray runner; and accessing the contents of the tray.

* * * * *